United States Patent [19]

Fulcheri

[11] Patent Number: 4,733,911

[45] Date of Patent: Mar. 29, 1988

[54] SUPPORT COLUMN FOR A HEIGHT-ADJUSTABLE SEAT, AND A SEAT COMPRISING SAID COLUMN

[75] Inventor: Renato Fulcheri, Turin, Italy

[73] Assignee: Press S.p.A., Cuneo, Italy

[21] Appl. No.: 940,967

[22] Filed: Dec. 12, 1986

[30] Foreign Application Priority Data

Dec. 23, 1985 [IT] Italy ..... 68102 A/85

[51] Int. Cl.[4] ..... A47C 1/02

[52] U.S. Cl. ..... 297/345; 248/188.5; 267/131

[58] Field of Search ..... 297/345; 108/150, 197; 248/188, 188.5; 267/131

[56] References Cited

U.S. PATENT DOCUMENTS

| | | | |
|---|---|---|---|
| 3,741,514 | 6/1973 | Snurr | 297/345 X |
| 3,756,654 | 9/1973 | Bauer | 297/345 |
| 4,061,304 | 12/1977 | Schattmaier | 297/345 X |
| 4,108,416 | 8/1978 | Nagase et al. | 267/131 X |
| 4,245,826 | 1/1981 | Wirges | 297/345 X |
| 4,465,266 | 8/1984 | Hale | 297/345 X |

FOREIGN PATENT DOCUMENTS

| | | | |
|---|---|---|---|
| 34068 | 8/1981 | European Pat. Off. | 297/345 |

*Primary Examiner*—Peter A. Aschenbrenner
*Attorney, Agent, or Firm*—Popper, Bobis & Jackson

[57] ABSTRACT

A support column for height-adjustable seats is described, in which the tubular support element housing the guide bush of the seat raising element and the relative control mechanism is formed from a plastic coupling element which is provided externally with a Morse taper for fixing the column to the seat support base, and is connected in an axially rigid manner to the guide bush so as to fix it into the support element, and from a strengthening element in the form of an unworked tube mounted surrounding the coupling element.

11 Claims, 8 Drawing Figures

SUPPORT COLUMN FOR A HEIGHT-ADJUSTABLE SEAT, AND A SEAT COMPRISING SAID COLUMN

BACKGROUND OF THE INVENTION

This invention relates to an improved support column for a height-adjustable seat, in particular for office use, and to the seat comprising such a column. Support columns for height-adjustable seats currently comprise a support element constituted by a machined metal tube provided at its lower end with a Morse taper and a closing washer welded to said tube, and a plastics guide bush for the seat raising element, which is controlled by a spring or gas mechanism similar to a shock absorber, which is housed inside the metal tube. This type of column has the drawback of high production cost if considerable accuracy is required in the vertical movement of the raising element. In this respect, numerous mechanical machining operations have to be carried out on the metal tube (turning, inner reaming, tapering of one end, welding) which slow down and considerably complicate the production process. Moreover, the guide bush has to be fixed into the tube by retaining screws, because otherwise it would tend when in use to escape from its seat.

SUMMARY OF THE INVENTION

The object of the invention is to provide a support column for a height-adjustable seat which is free from the described drawbacks, and which in particular is of simple and economical construction by virtue of a structure which substantially does not require mechanical machining.

Said object is attained according to the invention by a support column for a height-adjustable seat, in particular for office use, of the type comprising a tubular support element provided at one end with a Morse taper enabling it to be fixed on to a support base, a guide bush arranged to cooperate with a raising element for said seat so as to guide its vertical sliding, and a raising mechanism housed inside said tubular support element for operating said raising element, characterised in that said tubular support element comprises a coupling element constructed of plastics material and provided externally with said Morse taper, and a strengthening element consisting of a piece of unworked cylindrical metal tube which is simply cut to size and fitted to said coupling element.

BRIEF DESCRIPTION OF THE DRAWINGS

Further objects and advantages of the support column for heightadjustable seats according to the invention, and of the seat obtained therewith, will be apparent from the description of some non-limiting embodiments thereof illustrated on the accompanying drawings, in which.

DETAILED DESCRIPTION OF THE INVENTION

Figure 1:
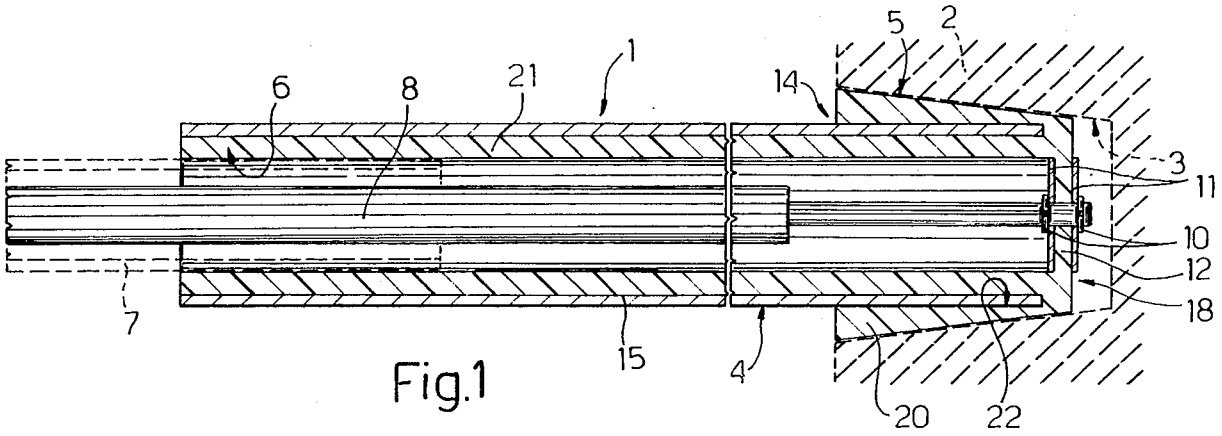
FIG. 1 shows a seat support column constructed in accordance with the invention.

In FIG. 1, the reference numeral 1 indicates overall a support column for a height-adjustable seat of any known type, not shown for simplicity, for example an office seat, to be connected to a support base 2 of said non-illustrated known seat, which is also of known type and of which, for simplicity, only the zone in which it is connected to the column 1 is illustrated diagrammatically, by hatching. The base 2, which is provided with suitable feet, not shown for simplicity, for its resting on the floor, is provided with a vertical frusto-conical seat 3 for its connection to the column 1, of known type, this seat being coupled by friction to a corresponding frusto-conical surface of a tubular support element 4 forming part of the column 1, said surface tapering at a suitable angle to form a Morse taper 5 of known type. In addition to the tubular element 4, the column 1 comprises a guide bush 6 for a known-type raising element 7 of said seat, not shown, and a raising mechanism 8, of known type, for controlling the element 7 and housed inside the tubular element 4. The mechanism 8 consists preferably of a gas spring, the upper end of which is connected in known manner to the element 7, and the lower end 9 of which is connected rigidly, by means of respective split rings 10 and washers 11, to the base wall 12 of the tubular element, the mechanism 8 further comprising known locking means, not shown for simplicity, for selectively halting the travel of the gas spring in a plurality of predetermined positions, such that when the mechanism 8 is released the bush 6 vertically guides the sliding of the element 7, and supports this latter in an extracted position when the mechanism 8 is locked, thus adjusting the height of said seat, not shown.

According to the invention, the tubular element 4 comprises a coupling element 14 constructed of synthetic plastics material and obtained directly by moulding, without the need for mechanical machining, and a strengthening element in the form of a piece 15 of unworked cylindrical metal tube which is simply cut to size and not machined in any manner, it being preferably formed by extrusion or drawing. According to the invention, the element 14 is provided externally with the Morse taper 5 preferably in correspondence with its lower end 18, and in the illustrated non-limiting example comprises a cup-shaped portion 20 defining the end 18 and provided laterally over its entire length with the taper 5, and a sleeve portion 21 of diameter less than the minimum diameter of the portion 20 and formed integrally and coaxially with this latter, to extend axially in a projecting manner from said portion 20 for fitting coaxially to the cylindrical tube piece 15. In particular, the portion 20 is closed towards its base by the wall 12, which is formed integrally in a single piece therewith from plastics material. In addition, the portion 20 is provided frontally, i.e. at the end comprising the portion 21, with a blind annular seat 22 formed in line with the portion 21, the tube piece 15 being forced over the portion 21 and into the seat 22, so that it becomes fitted tightly over the portion 21 and simultaneously inserted into the seat 22 as far as the bottom of this latter. The length of the piece 15 is chosen so that it terminates in line with the free end (the upper end) of the portion 21 when its lower end has been forced as far as the bottom of the seat 22, as shown in FIG. 1. Finally, in the illustrated embodiment, the bush 6, which is disposed in correspondence with the free end of the portion 21, is formed integrally in a single piece with the coupling element 14, so as to be axially rigid therewith, and in particular is defined by the actual upper terminal part of the portion 21. In a possible modification to the aforegoing embodiment, which is not illustrated for simplicity but corresponds to the most simple embodiment of the invention, the sleeve part 21 can be dispensed with, in which case the coupling element 14 consists of only the cup-shaped portion 20, the seat 22 of which will therefore not be annular but cylindrical, so that the entire coupling element 14 is formed from a plastics cup provided externally with the taper 5 and internally hollow so as to receive the lower end of the tube 15.

The considerable constructional advantages obtained by using a seat support column having the structure according to the invention are apparent from the aforegoing description. The element provided with the Morse taper for connection to the support base is entirely of plastics construction and therefore does not require any mechanical machining, in that the taper 5 and the base wall 12 for fixing the mechanism 8 can be obtained already finished during the moulding stage, simultaneously with the formation of the coupling element 14. This is then strengthened mechanically by a metal element which, being fitted to an element of plastics construction (and thus relatively deformable), does not have to be constructed to close dimensional tolerances, and can therefore be formed from a simple piece of unworked tube, or from another element which does not require any mechanical machining before assembly, except for the cutting operation. Again, in the case of the embodiment shown in FIG. 1, machining work relating to the fixing of the bush 6 is obviated according to the invention, as this latter is formed integrally with the element 14, it being defined by the projecting portion 21 thereof.

Figure 2:
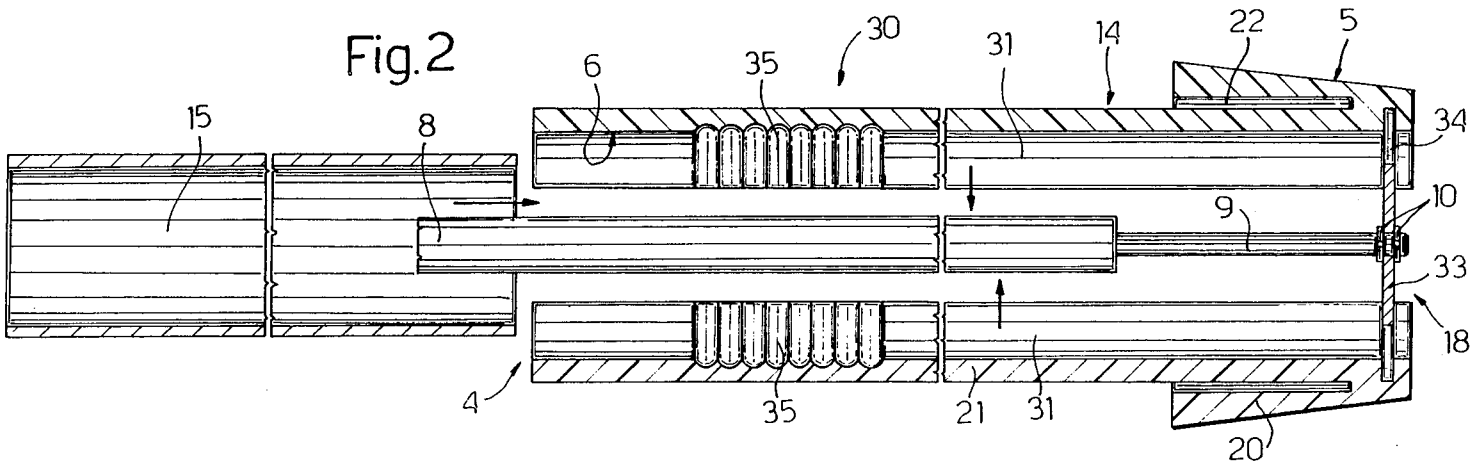
FIG. 2 shows a possible modification of the column of FIG. 1.

With reference now to FIG. 2, in this the reference numeral 30 indicates overall a column which is entirely analogous to the column 1, from which it differs only in certain details, those parts similar or equal to those already described being indicated for simplicity by the same reference numerals. The column 30, which is shown in exploded configuration, comprises the same elements as the column 1, and is constructed on an identical principle with the only difference that the coupling element 14 instead of being in a single piece consists of two symmetrical, identical semi-cylindrical shells 31, which when in use are kept held together longitudinally one against the other by the tube piece 15. This latter, in the illustrated non-limiting example, is drawn over the sleeve portion 21 defined by bringing the shells 31 together (by means of movements made in the direction of the arrows in FIG. 2), as far as into the annular seat 22, to prevent the shells 31 coming apart, it thus also keeping the element 14 assembled as though this were constructed in a single piece. Preferably, according to this modified embodiment, the base wall of the element 4 is not defined by a plastics wall 12 integral with the portion 20 but instead is defined by a metal washer 33 forced into an inner annular seat 34 in the element 14, formed in correspondence with the termination of the end 18, one half being in one of the shells 31 and the other half being in the other shell 31. With this modified embodiment it is possible to facilitate and economise on the moulding of the element 14, the washers 11 can be dispensed with, and the column 30 obtained in this manner is also able to house entirely mechanical mechanisms 8 of the known spring type, not shown for simplicity, the stop members of which require respective corrugated portions 35 disposed in the column 30. The portions 35 can be obtained by incorporating in the element 14 a corrugated tube of suitable length, or alternatively, as in the case of the illustrated modification, the corrugated portions 35 can be formed directly on the inside of each shell 31 in correspondence with the portion 21.

Finally, by means of this modified embodiment, it is possible either to form the bush 6 integrally with the portion 21, or, according to a non-illustrated further modification, use a conventional bush 6 which is fixed axially in the portion 21 by housing it between the shells 31 within a seat of the type indicated by 34, formed half in one shell 31 and half in the other shell 31.

Figure 8:
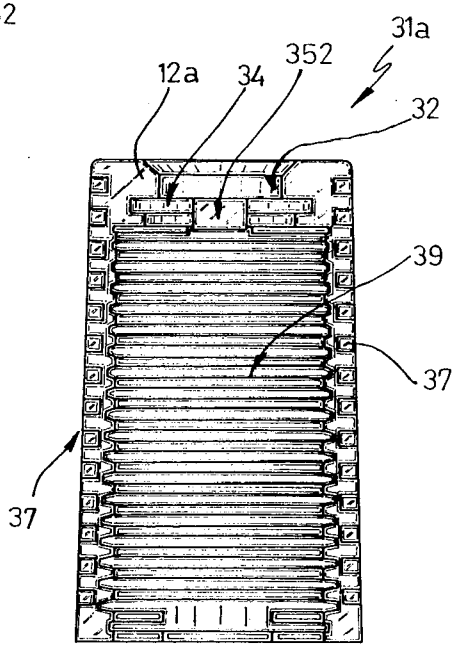
FIG. 8 shows a larger-scale detail of the FIG. 6 column.
Figure 7:
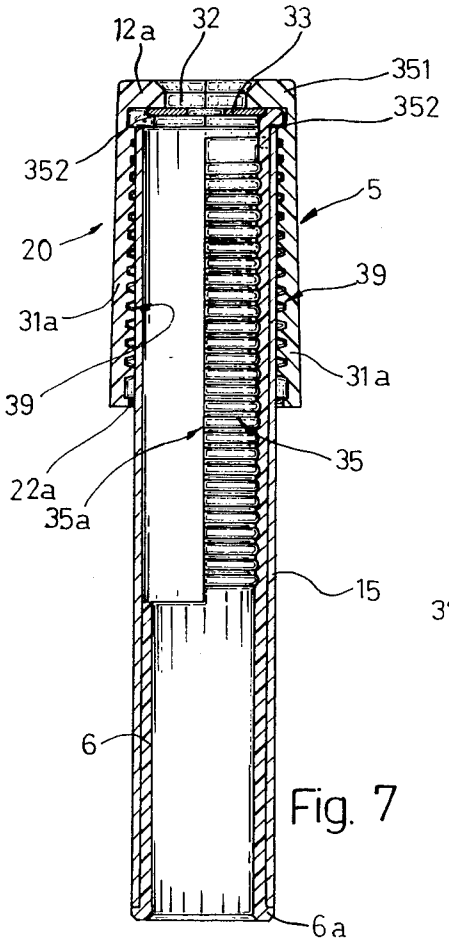
FIG. 7 shows a longitudinal section of part of the FIG. 6 column.
Figure 6:
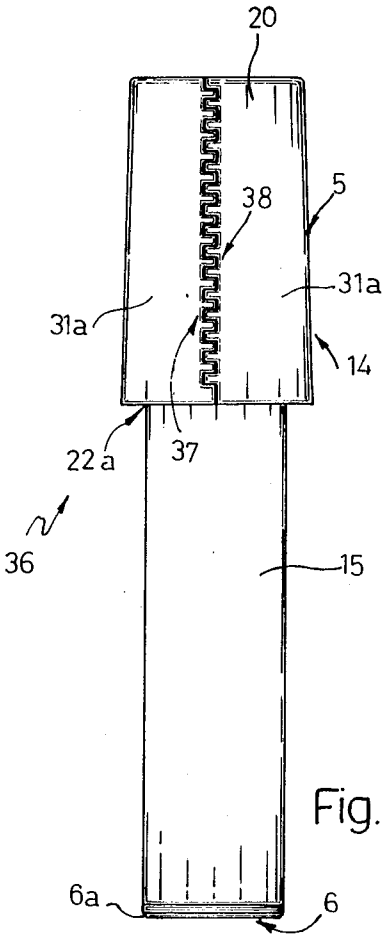
FIG. 6 shows a further modification of the support column according to the invention.

As on the said simplified variation of the FIG. 1 embodiment, element 14 of column 30 may obviously also be omitted from projecting portion 21, so that connection of the said two shells 31 defines a hollow cup composed solely of cup-shaped portion 20, inside which tube 15 is housed in a projecting manner, as shown in FIGS. 6, 7 and 8, which show a possible modification 36 of the FIG. 2 column 30 according to the aforementioned principle and as already described in connection with column 1. On column 36, which also comprises a mechanism 8 or the equivalent thereof (not visible and, therefore, not shown), coupling element 14 is composed solely of cup-shaped portion 20 (for the sake of simplicity, the same numbering system is used for parts similar or identical to those already described); the said cup-shaped portion 20, in turn, being formed by the connection of two symmetrical, semi-cylindrical shells **31*a*, each having, externally, a respective portion of Morse taper 5 and defining internally, when connected symmetrically side by side, a cylindrical seat 22*a* identical to annular seat 22 on column 1 and designed to house, by friction, the end portion of tube 15. On modification 36 also, tube 15 contributes towards keeping element 14 assembled, despite its being located solely inside the same, by virtue of the friction exerted between plastic shells 31*a* and metal tube 15 itself. Furthermore, for increasing the said friction and contributing towards keeping shells 31*a* assembled both together and on tube 15, each of the said shells 31*a* presents a pair of complementary toothed longitudinal edges, 37 and 38, designed to mate one inside the other, as shown in FIG. 6, and toothed, concave inner surfaces 39 defining seat 22*a*. Integral locking of shells 31*a* onto tube 15 is also assisted by the form of end wall 12*a* on portion 20, which, instead of being whole, as in the case of wall 12 on portion 20 of column 1, presents a centre through hole 32 (FIG. 8) inside which there is formed a seat 34 housing a washer 33 identical to that on column 30 and which completes wall 12*a*, by closing off the end of portion 20, and acts both as a key for locking shells 31*a* and as a coupling for mechanism 8. On the said further modification also, use may be made of a corrugated tube inside tube 15, for enabling the use of mechanical mechanisms 8; the said corrugated tube, by means of click-on connections, being employable for ensuring axial connection of a traditional type bush 6 and element 14 as a whole, in place of the omitted portion 21**. In more detail, according to modification 36, cylindrical bush 6 presents a shoulder 6a abutting with the free end of tube 15 on the opposite side to portion 20. Bush 6 is housed inside tube 15 and retained inside the same by a corrugated element 35a preferably formed integral with bush 6 or, according to a modification not shown, designed to click onto bush 6 in any appropriate manner, e.g. by means of connecting teeth. Whichever the case may be, according to the invention, element 35a, which presents a corrugated internal portion 35, is axially integral with bush 6 and, at the same time, is also rendered axially integral with cup-shaped portion 20, e.g. by means of a tooth 351 designed to click inside a radial seat 352 formed on one or both of shells 31a in annular seat 34 for washer 33. In the example shown, both shells 31a present, symmetrically, a seat 352, only one of which, however, is engaged by tooth 351; and element 35a consists of a semi-cylindrical crown occupying only half the circumference of tube 15, so as to reduce the weight and cost of column 36 by virtue of reducing the amount of material employed. When shells 31a are mated, tooth 351 is locked inside seat 352 by washer 33, thus forming one piece of portion 20 and element 35a which is actually equivalent in all respects to omitted portion 21.

Figure 3:
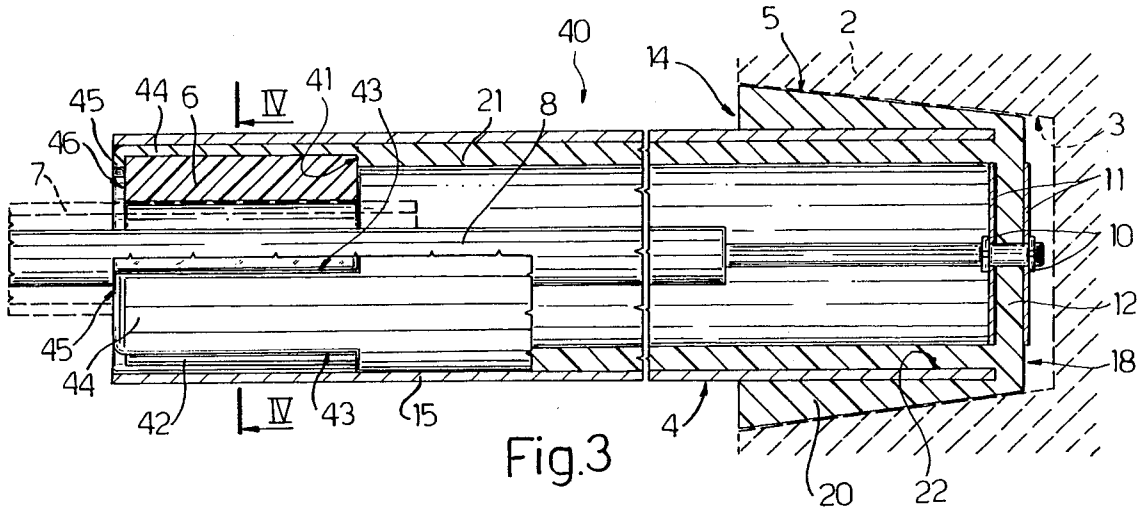
FIG. 3 shows a further modification of the support column according to the invention.
Figure 4:
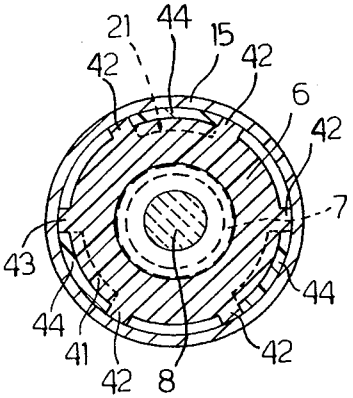
FIG. 4 is a section on the line IV—IV through the column of FIG. 3.
Figure 5:
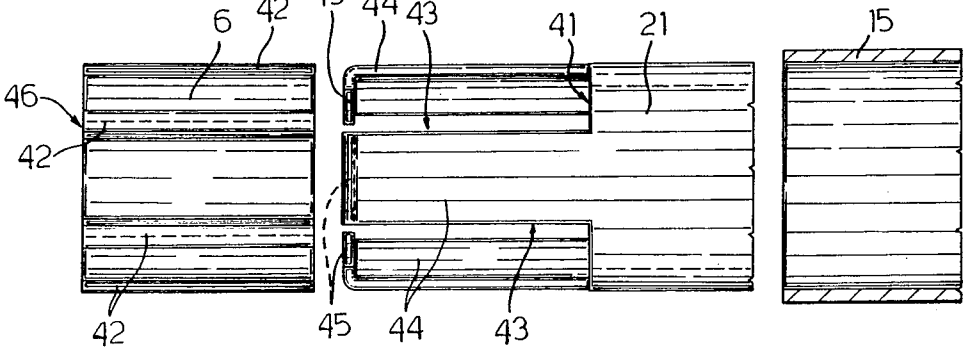
FIG. 5 is an exploded view of some details of the column of FIG. 3.

Finally with reference to FIGS. 3, 4 and 5, these show a further modified embodiment 40 of the column 1 according to the invention. Those details similar or equal to those already described are indicated by the same reference numerals for simplicity. The column 40 is substantially identical to the column 1 in its general structure, and in particular in the configuration of its lower end 18. It differs however from the column 1 with regard to the upper or free end of the portion 21, and to the arrangement of the bush 6. In this respect, this latter instead of being formed integrally with the portion 21 is of conventional type, being defined by an independent annular element of plastics construction and housed axially in the portion 21 abutting against a radially inward annular axial shoulder 41 of the element 14. The bush 6 is provided externally with respective longitudinal fins 42 by which it is directly inserted into the terminal part of the tube portion 15, in correspondence with the upper end of the portion 21. This is provided with respective frontally open longitudinal slots 43 housing the fins 42, and with respective elasticated projecting portions 44 defined by the slots 43 and provided frontally with respective radially inward stop lugs 45, which when the column 40 is assembled engage the front edge 46 of the bush 6 so as to axially lock this latter in the tube 15, within the portion 21 of the element 14 and rigidly therewith, between the axial shoulder 41 and the opposite axial shoulder formed by the lugs 45. Because of this modification it is possible to use a commercially available conventional bush, which can be constructed of the most suitable plastics material for its specified task, for example of acetal resin, and in any event different from the plastics material used for forming the coupling element 14, without sacrificing the advantages of the invention in terms of the lack of need for finishing machining and/or for the installation of retaining members for the bush 6. This is because this latter, being relatively deformable, can be connected without difficulty even to an unmachined tube, such as the piece of unworked tube 15, by firstly being snap-engaged with the elastic portions 44, to then remain locked between these on mounting the tube 14 over the portion 41, to prevent any radial deformation of the portions 44, and retain the bush 6 between them without further fixing operations.

From the description it is apparent that substantial technical progress is obtained in the construction of height-adjustable seats by the use in such seats of a support column constructed according to the present invention. Finally, it is apparent that modifications can be made to the described embodiments but without leaving the scope of the present invention.

I claim:

1. A support column (1, 30, 40) for connecting a seat in a height-adjustable manner, in particular for office use, to a support base (2), said support column comprising a tubular support element (4) provided at one end with a Morse taper (5) enabling it to be connected with said support base (2), and at the opposite end with a bush (6) arranged to cooperate with a raising element (7) of the seat so as to guide vertical sliding of the raising element, and a raising mechanism (8) housed inside said tubular support element (4) for operating said raising element to provide vertical movement of the seat, said tubular support element (4) including a coupling element (14) constructed of plastics material and which is arranged to connect the tubular support element (4) to said support base (2), said coupling element (14) including said Morse taper (5) as a portion thereof and provided externally thereon for engaging with the support base, and a strengthening element formed of a piece of unworked cylindrical metal tube (15) which is simply cut to size and fitted to said coupling element (14).

2. A support column as claimed in claim 1, characterised in that said coupling element (14) has a longitudinal axis, is axially fixed with said bush along said axis, and thereby retains said bush in position within said tubular support element (4).

3. A support column as claimed in claim 1 characterised in that said coupling element (14) is constituted by two semi-cylindrical shells (31, 31a) coupled to each other and kept longitudinally engaged one against the other by said tube piece (15).

4. A support column as claimed in claim 2 characterised in that said coupling element (14) comprises a cup-shaped portion (20) defining the lower end (18) thereof and provided laterally with said Morse taper (5), and a sleeve portion (21) of diameter less than the minimum diameter of the cup-shaped portion (20) and extending axially in a projecting manner from this latter to be engaged coaxially by said tube piece (15), said cup-shaped portion (20) having an annular seat (22) at the end comprising the sleeve portion (21), said annular seat (22) being formed in line with said sleeve portion (21), said unworked tube piece (15) being forcibly driven over said sleeve portion (21), to embrace its exterior, as far as the inside of said annular seat (22) of the cup-shaped portion (20), and having a length such as to terminate in line with the free end of said sleeve portion (21) when driven as far as the bottom of said annular seat (22).

5. A support column as claimed in claim 4, characterised in that said bush (6) is formed integrally in a single piece with said coupling element (14), by being defined by said sleeve portion (21) thereof.

6. A support column as claimed in claim 4, characterised in that said bush (6) is housed coaxially in said sleeve portion (21) of said coupling element (14), to abut against a radially inward annular axial shoulder (41) of this latter, said coupling element (14) further comprising axial retention means (45) for preventing the bush (6) escaping from said sleeve portion (21).

7. A support column as claimed is claim 4, characterised in that said tube piece (15) is drawn over said shells (31) so as to prevent their moving apart, the base of said cup-shaped portion (20) of the coupling element (14) being defined by a metal washer (33) driven into an inner annular seat (34) of the coupling element (14) which is formed half in one of said semi-cylindrical shells (31) and the other half in the other said shell (31).

8. A support column as claimed in claim 7, characterised in that said sleeve portion (21) is provided internally, on each shell (31), with respective corrugated portions (35) arranged to cooperate with a mechanical raising and stop mechanism (8).

9. A support column as claimed in claim 6, characterised in that said bush (6) is externally finned longitudinally and is directly driven into said tube piece (15) in correspondence with a free end of the sleeve portion (21) of the coupling element (14), said sleeve portion being provided with respective open longitudinal slots (43) housing the fins of said bush (6), said axial retention means comprising respective elasticated projecting portions (44) of said free end of the sleeve portion, which are bounded by said longitudinal slots (41) and are provided frontally with respective radially inward retention lugs (45) engaging the front edge of said bush (6).

10. A support column as claimed in claim 3, characterised in that the said coupling element (14) consists solely of a cup-shaped portion (20) formed by mutually and symmetrically joining the said two semi-cylindrical shells (31*a*); the said guide bush (6) being driven directly inside the said tube portion (15) and having a shoulder (6*a*) abutting with the free end of the said tube portion (15) on the opposite side to the said cup-shaped portion (20), and being connected integral with the said cup-shaped portion (20) by means of a corrugated element (35*a*) integral with the said guide bush (6) and clicked onto the said cup-shaped portion (20) by means of a tooth (351) inserted inside a radial seat (352) formed on at least one of the said shells (31*a*) in an annular seat (34) formed in the said shells (31*a*) and housing a washer (33) arranged so as to close off the end of the said cup-shaped portion (20) and to lock the said tooth (351).

11. A support column as claimed in claim 10, characterised in that said shells (31*a*) present respective pairs of complementary toothed edges (37, 38) designed to cooperate when the said shells (31*a*) are mated, and respective concave, toothed inner sufaces (38); the said annular seat (34) being formed in a through hole (32) through the end wall (12*a*) of the said cup-shaped portion (20).

* * * * *